US007061758B2

(12) United States Patent
Liu et al.

(10) Patent No.: US 7,061,758 B2
(45) Date of Patent: Jun. 13, 2006

(54) HEAT-DISSIPATING FAN DEVICE

(75) Inventors: Hung-Sheng Liu, Kaohsiung (TW); Ya-Yu Chao, Kaohsiung (TW)

(73) Assignee: Asia Vital Components Co., Ltd., Kaohsiung (TW)

( * ) Notice: Subject to any disclaimer, the term of this patent is extended or adjusted under 35 U.S.C. 154(b) by 272 days.

(21) Appl. No.: 10/717,819

(22) Filed: Nov. 20, 2003

(65) Prior Publication Data

US 2005/0122695 A1 Jun. 9, 2005

(51) Int. Cl.
*H05K 7/20* (2006.01)

(52) U.S. Cl. ..... 361/695; 361/694; 361/693; 361/703

(58) Field of Classification Search ..... 361/687–688, 361/693–697, 607, 690, 701–703
See application file for complete search history.

(56) References Cited

U.S. PATENT DOCUMENTS 5,591,008 A * 1/1997 Wrobel et al. ..... 416/144
6,163,453 A * 12/2000 Hou et al. ..... 361/687
6,459,580 B1 * 10/2002 Della Fiora et al. ..... 361/697
6,657,863 B1 * 12/2003 Lee et al. ..... 361/697

* cited by examiner

*Primary Examiner*—Kamand Cuneo
*Assistant Examiner*—Hung s. Bui

(74) *Attorney, Agent, or Firm*—Merchant & Gould P.C.

(57) ABSTRACT

A fan impeller of a heat-dissipating fan device is mounted in a receiving space of a fan housing, and includes coupling ribs that extend radially and outwardly from an outer surrounding surface of a hub cap and that are spaced apart angularly from each other, a smaller-diameter first connecting ring disposed coaxially around an intermediate portion of the hub cap and connected to the coupling ribs, a larger-diameter second connecting ring disposed coaxially around a lower portion of the hub cap, and fan blades that are spaced apart angularly from each other. Each fan blade has a first blade body connected to and disposed uprightly on the first connecting ring, and a second blade body connected to and extending radially from the first blade body and having a bottom end connected to the second connecting ring.

7 Claims, 8 Drawing Sheets

HEAT-DISSIPATING FAN DEVICE

BACKGROUND OF THE INVENTION

1. Field of the Invention

The invention relates to a fan device, more particularly to a heat-dissipating fan device.

2. Description of the Related Art

FIG. 1 illustrates a conventional heat-dissipating fan device 1 that includes a fan housing 10 and a fan impeller 12. The fan housing 10 has a top wall 13 formed with an inlet 131, a bottom wall 14, and a side wall 11 transverse to the top and bottom walls 13, 14 and formed with an outlet 111. The top, bottom and side walls 13, 14, 11 confine a receiving space 15. The fan impeller 12 is mounted in the receiving space 14 of the fan housing 10.

Referring to FIGS. 2 to 4, the fan impeller 12 includes a hub cap 121, a plurality of coupling ribs 122, a first connecting ring 125, a second connecting ring 124, and a plurality of fan blades 123. The hub cap 121 has opposite upper and lower portions 1211, 1212. The coupling ribs 122 extend radially and outwardly from the lower portion 1212 of the hub cap 121 (see FIG. 4), and are spaced apart angularly from each other (see FIG. 3). The first connecting ring 125 is disposed coaxially around the lower portion 1212 of the hub cap 121, and is connected to the coupling ribs 122. The second connecting ring 124 is disposed coaxially around the upper portion 1211 of the hub cap 121. The fan blades 123 are spaced apart angularly from each other (see FIG. 3). Each fan blade 123 extends radially, and is connected to and is disposed uprightly on the first connecting ring 125. Each fan blade 123 has an outer lateral edge connected to the second connecting ring 124. As such, rotation of the fan impeller 12 draws air to flow from the inlet 131 of the fan housing 10 toward the outlet 111 of the fan housing 10.

However, during rotation of the fan impeller 12, air drawn into the receiving space 15 initially flows downwardly toward the bottom wall 14 of the fan housing 10, and is subsequently directed to flow radially toward the outlet 111 of the fan housing 10 such that the conventional heat-dissipating device 1 cannot generate a stable airflow amount as a result of airflow disturbance in the receiving space 15 of the fan housing 10. Furthermore, the second connecting ring 124 obstructs airflow through the outlet 111.

SUMMARY OF THE INVENTION

Therefore, the object of the present invention is to provide a heat-dissipating fan device that can generate an enhanced airflow amount.

According to one aspect of the present invention, a heat-dissipating fan device comprises:

a fan housing confining a receiving space and including a top wall, and a side wall transverse to the top wall, the top wall being formed with an inlet for access into the receiving space, the side wall being formed with an outlet in fluid communication with the receiving space; and a fan impeller mounted in the receiving space of the fan housing and rotatable about a central axis that is transverse to the top wall of the fan housing, the fan impeller including:

a hub cap having an outer surrounding surface that is disposed to surround the central axis, the hub cap having opposite upper and lower portions, and an intermediate portion interconnecting the upper and lower portions;

a plurality of coupling ribs extending radially and outwardly from the outer surrounding surface of the hub cap, and spaced apart angularly from each other, each of the coupling ribs having a first end connected to the outer surrounding surface of the hub cap, and a second end opposite to the first end;

a first connecting ring disposed coaxially around the intermediate portion of the hub cap, the first connecting ring being connected to the second ends of the coupling ribs;

a second connecting ring disposed coaxially around the lower portion of the hub cap, the second connecting ring having a diameter larger than that of the first connecting ring; and a plurality of fan blades spaced apart angularly from each other, each of the fan blades having a first blade body connected to and disposed uprightly on the first connecting ring, and a second blade body connected to and extending radially from the first blade body, the second blade body having a bottom end connected to the second connecting ring, each adjacent pair of the fan blades confining an air passage therebetween.

Rotation of the fan impeller draws air to flow from the inlet of the fan housing toward the outlet of the fan housing through the air passages.

According to another aspect of the present invention, a fan impeller comprises:

a hub cap having an outer surrounding surface that is disposed to surround a central axis, the hub cap having opposite upper and lower portions, and an intermediate portion interconnecting the upper and lower portions;

a plurality of coupling ribs extending radially and outwardly from the outer surrounding surface of the hub cap, and spaced apart angularly from each other, each of the coupling ribs having a first end connected to the outer surrounding surface of the hub cap, and a second end opposite to the first end;

a first connecting ring disposed coaxially around the intermediate portion of the hub cap, the first connecting ring being connected to the second ends of the coupling ribs;

a second connecting ring disposed coaxially around the lower portion of the hub cap, the second connecting ring having a diameter larger than that of the first connecting ring; and a plurality of fan blades spaced apart angularly from each other, each of the fan blades having a first blade body connected to and disposed uprightly on the first connecting ring, and a second blade body connected to and extending radially from the first blade body, the second blade body having a bottom end connected to the second connecting ring, each adjacent pair of the fan blades confining an air passage therebetween.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
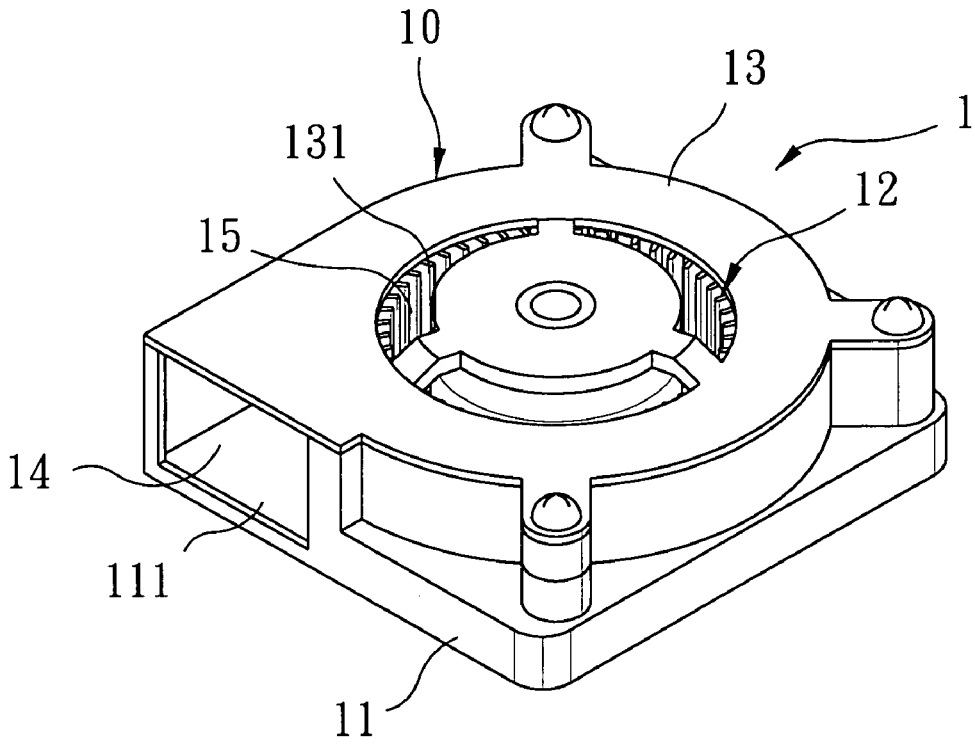
FIG. 1 PRIOR ART
FIG. 1 is a perspective view of a conventional heat-dissipating fan device.
Figure 2:
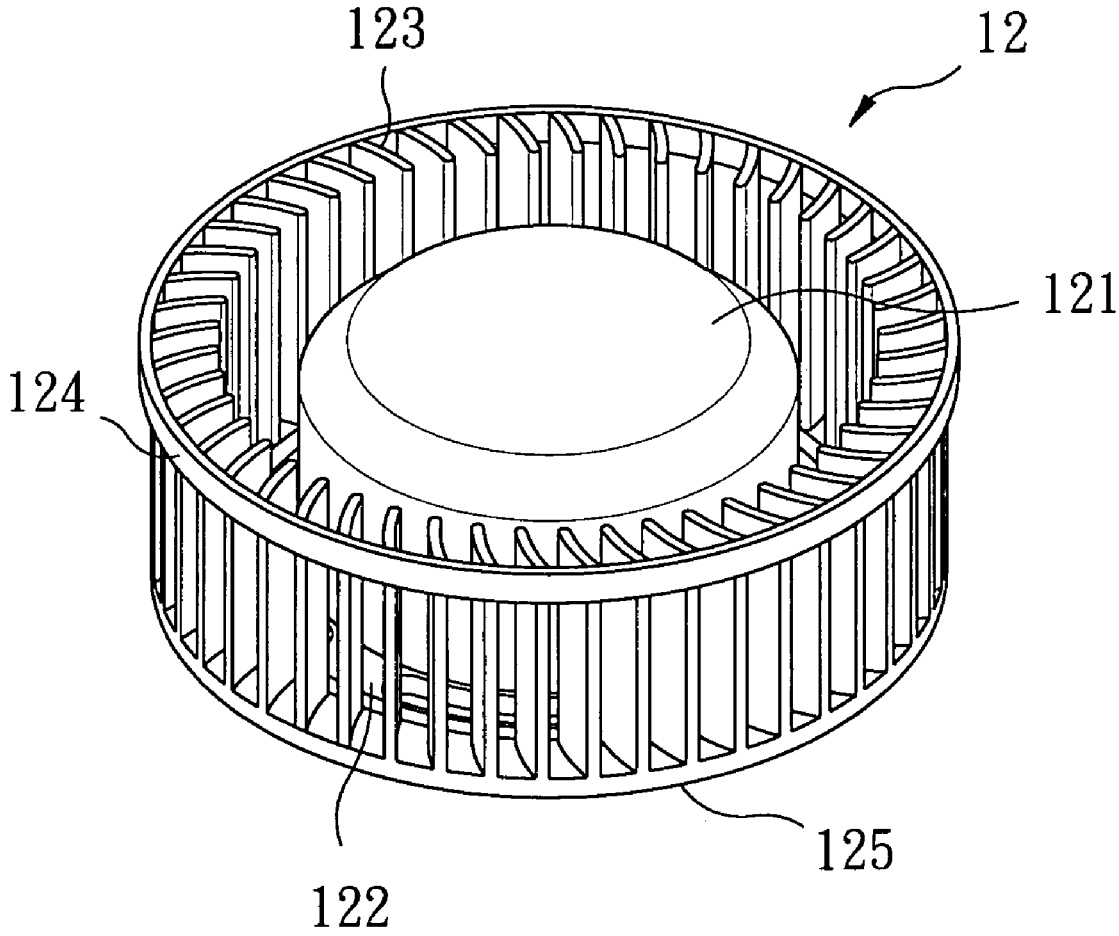
FIG. 2 PRIOR ART
FIG. 2 is a perspective view of a fan impeller of the conventional heat-dissipating fan device.
Figure 3:
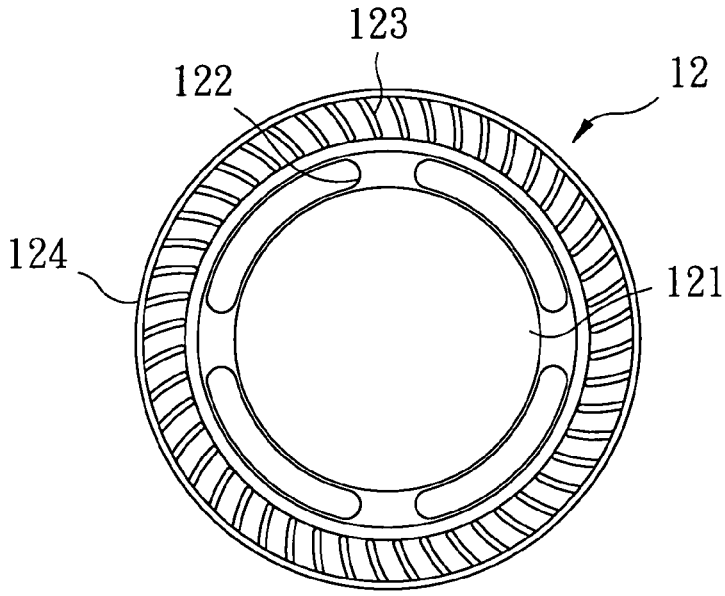
FIG. 3 PRIOR ART
FIG. 3 is a schematic top view of the fan impeller of FIG. 2.
Figure 4:
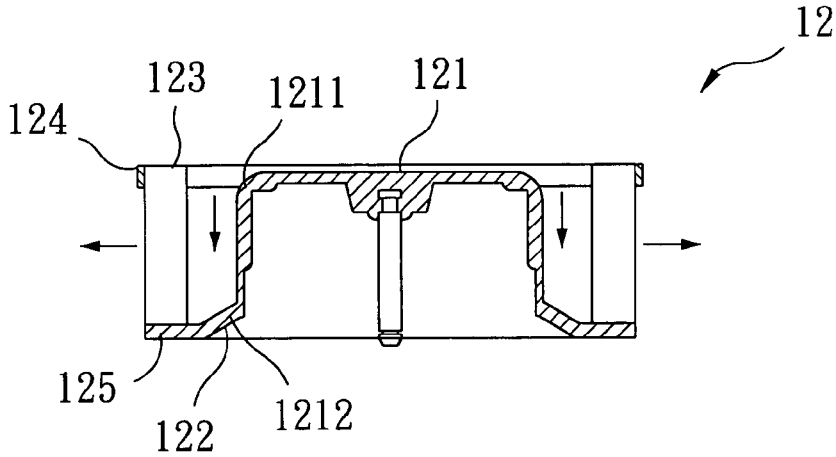
FIG. 4 PRIOR ART
FIG. 4 is a schematic sectional view of the fan impeller of FIG. 2.

Before the present invention is described in greater detail, it should be noted that like elements are denoted by the same reference numerals throughout the disclosure.

Figure 5:
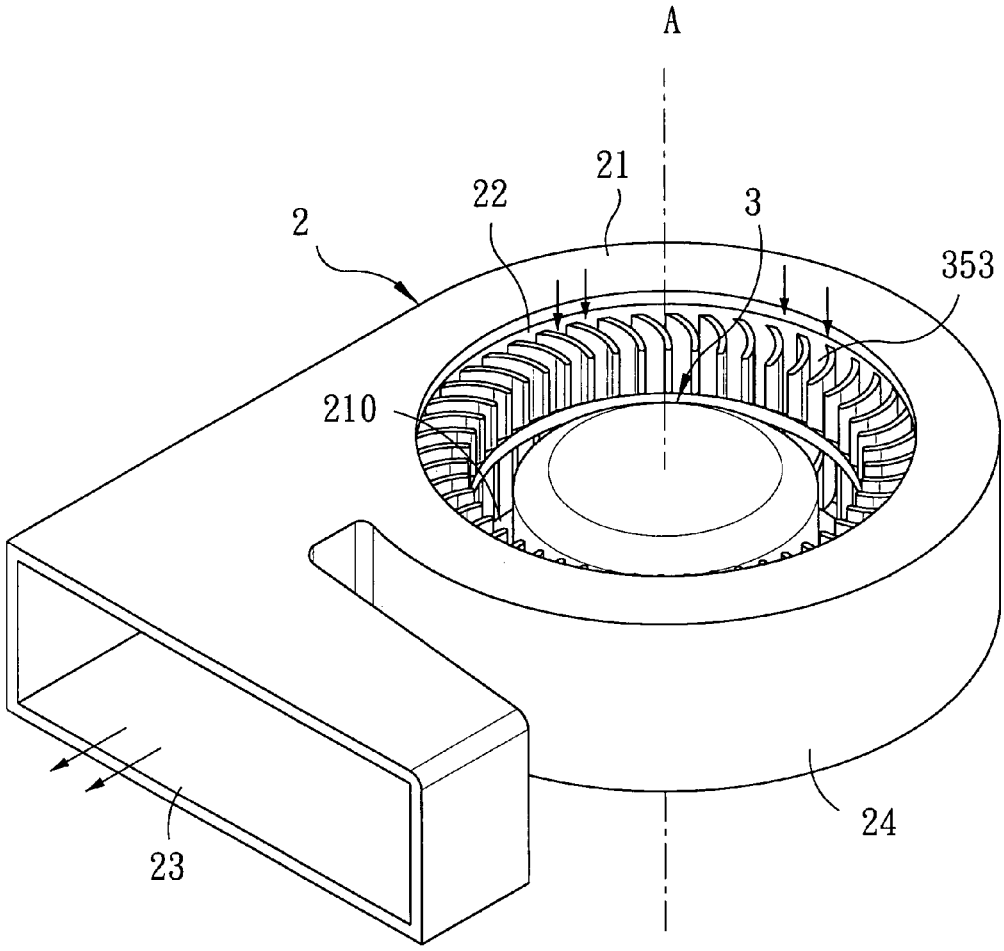
FIG. 5 is a perspective view showing the first preferred embodiment of a heat-dissipating fan device according to this invention.

Referring to FIG. 5, the first preferred embodiment of a heat-dissipating fan device according to the present invention is shown to include a fan housing 2 and a fan impeller 3.

The fan housing 2 confines a receiving space 210, and includes a top wall 21, and a side wall 24 transverse to the top wall 21. The top wall 21 is formed with an inlet 22 for access into the receiving space 210. The side wall 24 is formed with an outlet 23 in fluid communication with the receiving space 210.

Figure 6:
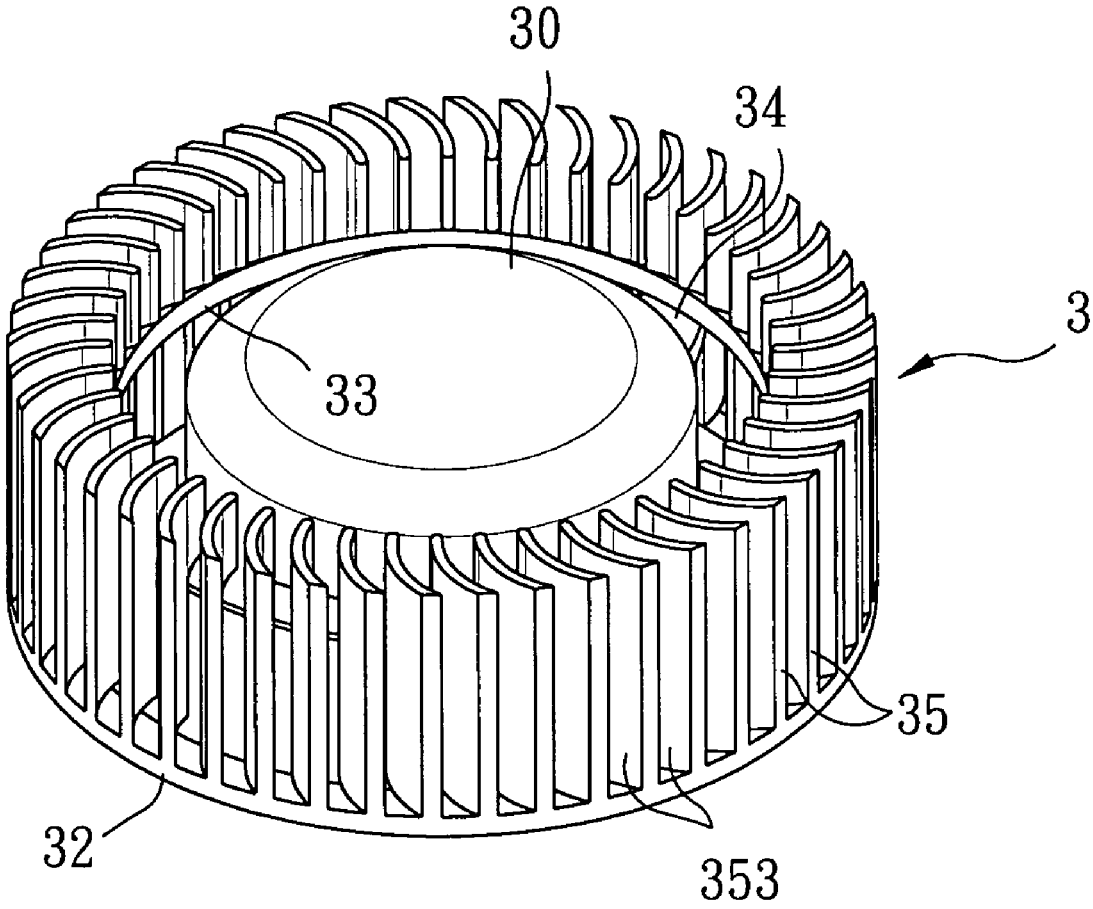
FIG. 6 is a perspective view showing a fan impeller of the first preferred embodiment.
Figure 7:
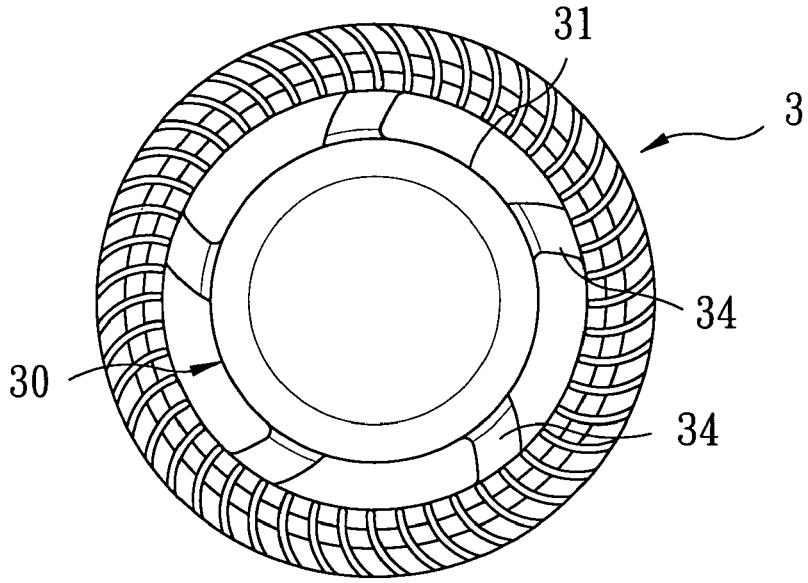
FIG. 7 is a schematic top view showing the fan impeller of the first preferred embodiment.
Figure 8:
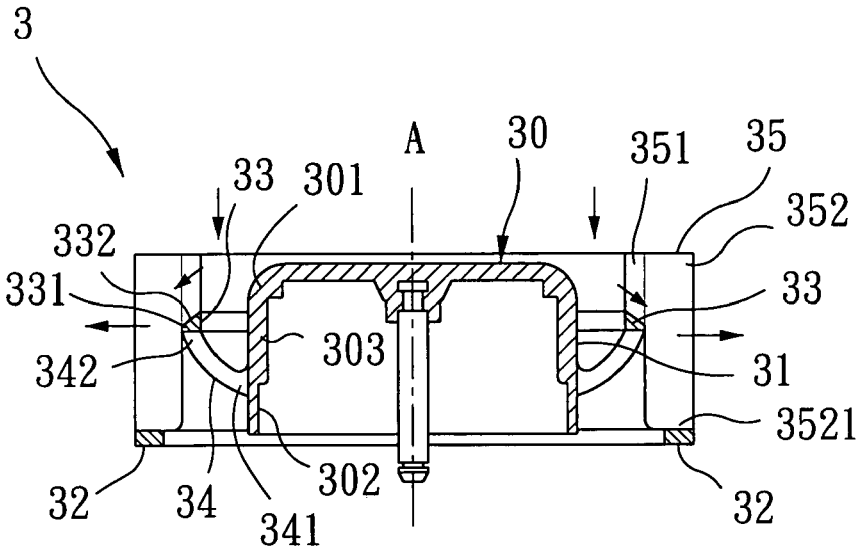
FIG. 8 is a schematic sectional view showing the fan impeller of the first preferred embodiment.

The fan impeller 3 is mounted in the receiving space 210 of the fan housing 2, and is rotatable about a central axis (A) that is transverse to the top wall 21 of the fan housing. Referring to FIGS. 6 to 8, the fan impeller 3 includes a hub cap 30, a plurality of coupling ribs 34, a first connecting ring 33, a second connecting ring 32, and a plurality of fan blades 35.

As shown in FIG. 8, the hub cap 30 has an outer surrounding surface 31 that is disposed to surround the central axis (A). The hub cap 30 has opposite upper and lower portions 301, 302, and an intermediate portion 303 interconnecting the upper and lower portions 301, 302.

The coupling ribs 34 extend radially and outwardly from the outer surrounding surface 31 of the hub cap 30, and are spaced apart angularly from each other, as best shown in FIG. 7. Each of the coupling ribs 34 has a first end 341 connected to the outer surrounding surface 31 of the hub cap 30, and a second end 342 opposite to the first end 341. In this embodiment, the first end 341 of each coupling rib 34 is connected to the lower portion 302 of the hub cap 30. Each coupling rib 34 curves upwardly from the outer surrounding surface 30 of the hub cap 31 (see FIG. 8).

As shown in FIG. 8, the first connecting ring 33 is disposed coaxially around the intermediate portion 303 of the hub cap 30. The first connecting ring 34 is connected to the second ends 342 of the coupling ribs 34. In this embodiment, the first connecting ring 33 has a bottom surface 331 connected to the second ends 342 of the coupling ribs 34, and a radially and downwardly inclined top surface 332 (see FIG. 8).

The second connecting ring 32 is disposed coaxially around the lower portion 302 of the hub cap 30, as shown in FIG. 8. The second connecting ring 32 has a diameter larger than that of the first connecting ring 33.

The fan blades 35 are spaced apart angularly from each other, as shown in FIG. 6. Each of the fan blades 35 has a first blade body 351 connected to and disposed uprightly on the inclined top surface 332 of the first connecting ring 33, and a second blade body 352 connected to and extending radially from the first blade body 351. The second blade body 352 of each fan blade 35 has a bottom end 3521 connected to the second connecting ring 32, as shown in FIG. 8. Each adjacent pair of the fan blades 35 confine an air passage 353 therebetween, as shown in FIG. 6. In this embodiment, each of the fan blades 35 has a curved cross section, as shown in FIG. 7. Preferably, the first blade body 351 has a height that is substantially a third of that of the second blade body 352, and an arc length that is substantially a third of that of the second blade body 352.

In view of the aforesaid construction, rotation of the fan impeller 3 draws air to flow from the inlet 22 of the fan housing 2 toward the outlet 23 of the fan housing 2 through the air passages 353, as indicated by solid arrows in FIG. 5.

Figure 9:
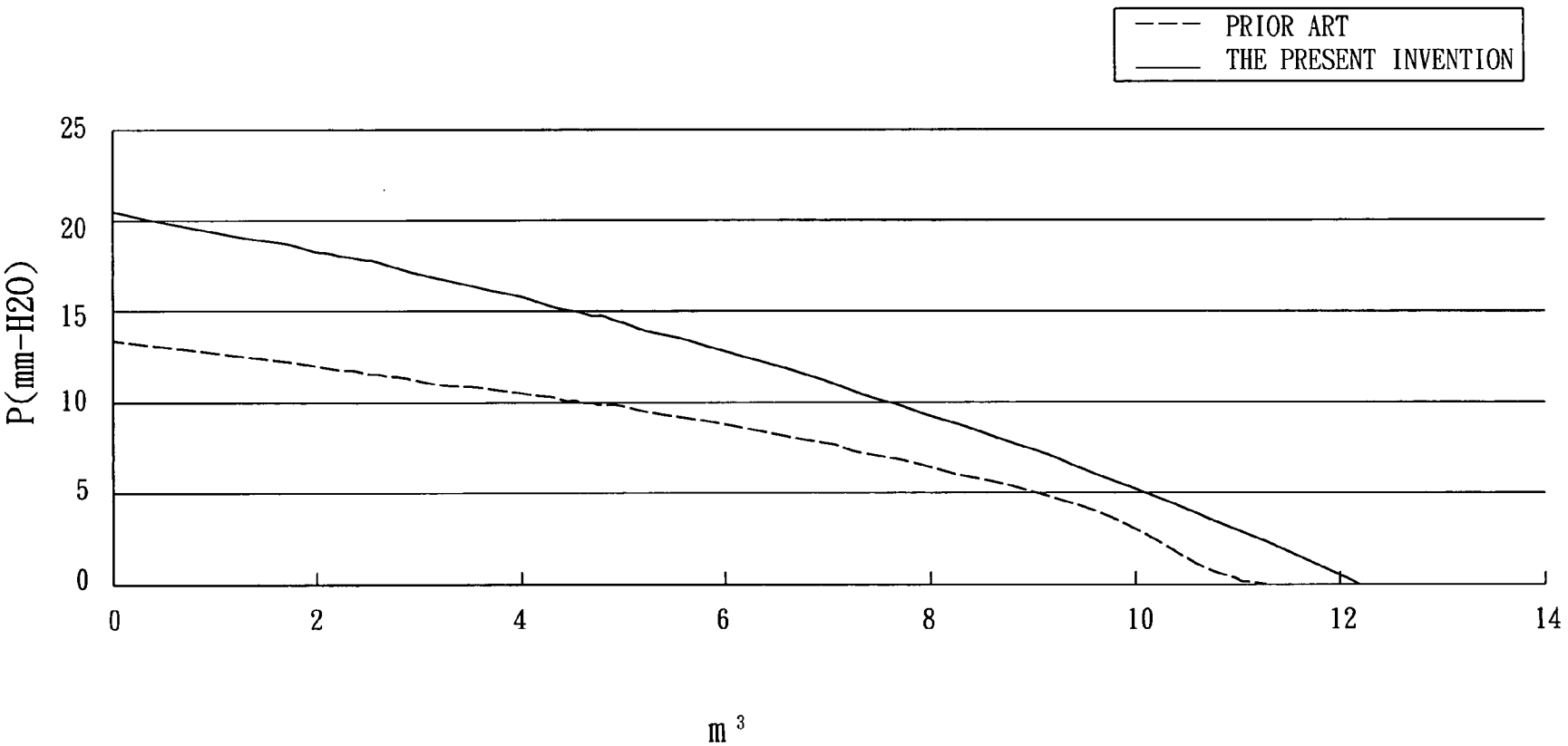
FIG. 9 is a plot showing experimental results of wind pressure generated by the conventional heat-dissipating fan device and the first preferred embodiment.

It is noted that, due to the presence of the inclined top surface 332 of the first connecting ring 33 and the curved coupling ribs 34, air flowing from the inlet 22 of the fan housing 2 can be smoothly guided toward the outlet 23 of the fan housing 2, as indicated by the solid arrows in FIG. 8. Therefore, wind resistance of airflow drawn into the receiving space 210 (see FIG. 5) of the fan housing 2 can be reduced. Accordingly, the heat-dissipating fan device of this invention can generate enhanced airflow amount. Based on the experimental result shown in FIG. 9, the heat-dissipating fan device of this invention can generate airflow with a wind pressure larger than that of the aforesaid conventional heat-dissipating fan device.

Figure 10:
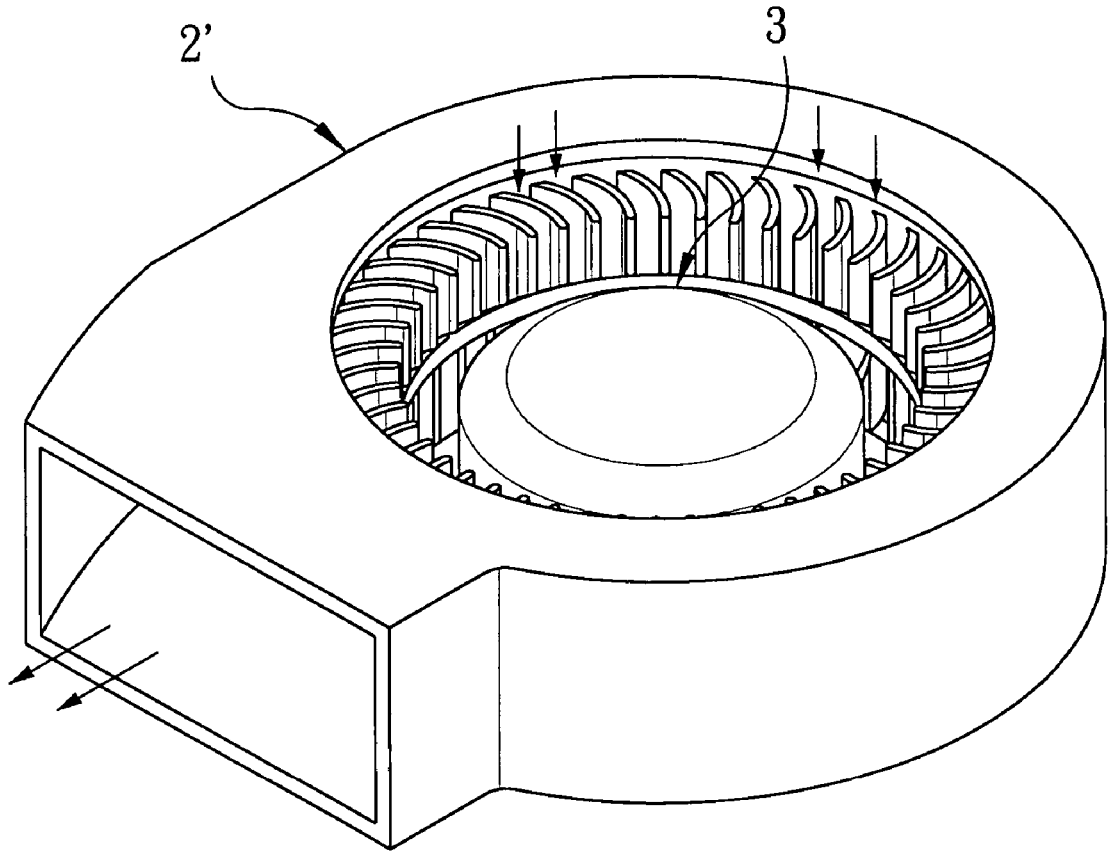
FIG. 10 is a perspective view showing the second preferred embodiment of a heat-dissipating fan device according to this invention.

FIG. 10 illustrates the second preferred embodiment of a heat-dissipating fan device according to this invention, which is a modification of the first preferred embodiment. In this embodiment, the fan housing 2' has a shape different from that of the fan housing 2 in the first preferred embodiment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A heat-dissipating fan device comprising:

a fan housing confining a receiving space and including a top wall, and a side wall transverse to said top wall, said top wall being formed with an inlet for access into said receiving space, said side wall being formed with an outlet in fluid communication with said receiving space; and a fan impeller mounted in said receiving space of said fan housing and rotatable about a central axis that is transverse to said top wall of said fan housing, said fan impeller including:

a hub cap having an outer surrounding surface that is disposed to surround the central axis, said hub cap having opposite upper and lower portions, and an intermediate portion interconnecting said upper and lower portions;

a plurality of coupling ribs extending radially and outwardly from said outer surrounding surface of said hub cap, and spaced apart angularly from each other, each of said coupling ribs having a first end connected to said outer surrounding surface of said hub cap, and a second end opposite to said first end;

a first connecting ring disposed coaxially around said intermediate portion of said hub cap, said first connecting ring being connected to said second ends of said coupling ribs;

a second connecting ring disposed coaxially around said lower portion of said hub cap, said second connecting ring having a diameter larger than that of said first connecting ring; and a plurality of fan blades spaced apart angularly from each other, each of said fan blades having a first blade body connected to and disposed uprightly on said first connecting ring, and a second blade body connected to and extending radially from said first blade body, said second blade body having a bottom end connected to said second connecting ring, each adjacent pair of said fan blades confining an air passage therebetween;

whereby, rotation of said fan impeller draws air to flow from said inlet of said fan housing toward said outlet of said fan housing through said air passages.

2. The heat-dissipating fan device as claimed in claim 1, wherein each of said fan blades has a curved cross section.

3. The heat-dissipating fan device as claimed in claim 1, wherein said first end of each of said coupling ribs is connected to said lower portion of said hub cap, each of said coupling ribs curving upwardly from said outer surrounding surface of said hub cap to said first connecting ring.

4. The heat-dissipating fan device as claimed in claim 1, wherein said first connecting ring has a bottom surface connected to said second ends of said coupling ribs, and a radially and downwardly inclined top surface connected to said first blade bodies of said fan blades.

5. The heat-dissipating fan device as claimed in claim 1, wherein said first blade body has a height that is substantially a third of that of said second blade body.

6. The heat-dissipating fan device as claimed in claim 2, wherein said first blade body has an arc length that is substantially a third of that of said second blade body.

7. A fan impeller comprising:

a hub cap having an outer surrounding surface that is disposed to surround a central axis, said hub cap having opposite upper and lower portions, and an intermediate portion interconnecting said upper and lower portions;

a plurality of coupling ribs extending radially and outwardly from said outer surrounding surface of said hub cap, and spaced apart angularly from each other, each of said coupling ribs having a first end connected to said outer surrounding surface of said hub cap, and a second end opposite to said first end;

a first connecting ring disposed coaxially around said intermediate portion of said hub cap, said first connecting ring being connected to said second ends of said coupling ribs;

a second connecting ring disposed coaxially around said lower portion of said hub cap, said second connecting ring having a diameter larger than that of said first connecting ring; and a plurality of fan blades spaced apart angularly from each other, each of said fan blades having a first blade body connected to and disposed uprightly on said first connecting ring, and a second blade body connected to and extending radially from said first blade body, said second blade body having a bottom end connected to said second connecting ring, each adjacent pair of said fan blades confining an air passage therebetween.

* * * * *